US006877243B2

(12) United States Patent
Carlson et al.

(10) Patent No.: US 6,877,243 B2
(45) **Date of Patent: *Apr. 12, 2005**

(54) SHAPE CUTTING SYSTEM

(75) Inventors: Christopher R. Carlson, Wausau, WI (US); William J. Schulz, Mosinee, WI (US); Jamieson Foght, Wausau, WI (US)

(73) Assignee: Alterra Holdings Corporation, Tigard, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/791,069

(22) Filed: Mar. 2, 2004

(65) Prior Publication Data

US 2004/0168557 A1 Sep. 2, 2004

Related U.S. Application Data

(63) Continuation of application No. 09/769,683, filed on Jan. 25, 2001, now Pat. No. 6,722,051.

(51) Int. Cl.[7] ..... B43L 13/20

(52) U.S. Cl. ..... 33/562; 33/27.12; 33/41.5; 408/204; 30/296.1; 30/293; 144/144.1; 144/372

(58) Field of Search ..... 33/18.1, 27.12, 33/41.5, 528, 562, 563, 566; 408/204, 703; 30/300, 310, 315, 316, 296.1, 293, 294; 144/144.1, 372

(56) References Cited

U.S. PATENT DOCUMENTS 3,156,984 A 11/1964 Palmer
3,456,346 A * 7/1969 Snyder ..... 30/310
3,576,148 A 4/1971 Katz
3,633,286 A 1/1972 Maurer
3,753,382 A 8/1973 Anfindsen
3,778,905 A 12/1973 Jebb et al.
3,787,968 A 1/1974 Littmann
3,994,194 A * 11/1976 Moceri ..... 30/310
4,057,898 A 11/1977 Piosky
4,319,615 A 3/1982 Ditmanson
4,353,672 A 10/1982 Smith
4,382,590 A 5/1983 Pandya et al.
4,426,781 A 1/1984 Kufrin (Continued)

OTHER PUBLICATIONS

Coluzzle, Collage Template System, Nested Templates—Product Literature; California East, Ltd.; Jan. 1998.
Coluzzle, Collage Template System, Nested Templates—Product Literature; California East, Ltd.; Feb. 1999.
Coluzzle, Collage, Puzzle Template Instructions—Product Literature; Provo Craft; 1999.
Patricia Shaw; "What Can You Do With A Doodle Cutter?"; Creating Keepsakes; Jul.–Aug. 1999.
Doodle Cutter, Instructions for Use; Minix, Inc.; Jul. 21, 2000.

*Primary Examiner*—Diego Gutierrez
*Assistant Examiner*—Madeline Gonzalez
(74) *Attorney, Agent, or Firm*—Foley & Lardner LLP

(57) ABSTRACT

A shape cutting system for cutting a material having a surface. The shape cutting system includes a cutting unit and at least one template. The cutting unit includes a frame, a blade adjustment assembly and a blade assembly are coupled to the frame. The blade assembly is positioned at least partially within the frame such that a longitudinal axis of the blade assembly is substantially perpendicular to a lower support surface of the frame. The blade assembly includes a blade retainer and a blade connected to the retainer. A rigid collar of the retainer is configured to operatively engage at least one of a periphery and the edge of an opening of the template thereby enabling the blade to cut a shape in the cutting material which assimilates the shape of at least a portion of the at least one of the periphery and the edge.

19 Claims, 5 Drawing Sheets

U.S. PATENT DOCUMENTS

| | | | | |
|---|---|---|---|---|
| 4,934,054 | A | | 6/1990 | Morozumi |
| 5,156,584 | A | | 10/1992 | Cohen et al. |
| 5,322,001 | A | | 6/1994 | Boda |
| 5,414,933 | A | | 5/1995 | Garner |
| 5,503,203 | A | | 4/1996 | Stornetta |
| 5,518,491 | A | | 5/1996 | Romer et al. |
| 5,557,996 | A | | 9/1996 | Reber et al. |
| 5,626,551 | A | | 5/1997 | Kearns et al. |
| 5,671,647 | A | | 9/1997 | Mori |
| 5,685,816 | A | | 11/1997 | Romer et al. |
| 5,802,942 | A | | 9/1998 | Cornell et al. |
| 5,855,543 | A | | 1/1999 | Carbone |
| 5,865,928 | A | | 2/1999 | Lariviere et al. |
| 6,036,628 | A | | 3/2000 | Romer |
| 6,112,425 | A | | 9/2000 | Nelson et al. |
| 6,158,133 | A | | 12/2000 | Carlson et al. |
| 6,216,577 | B1 | * | 4/2001 | Lira-Nunez et al. ..... 30/294 |
| 6,575,068 | B2 | * | 6/2003 | Lira-Nunez et al. ..... 30/294 |
| 6,722,051 | B2 | * | 4/2004 | Carlson et al. ..... 33/562 |
| 2004/0060180 | A1 | * | 4/2004 | Nelson ..... 33/18.1 |

* cited by examiner

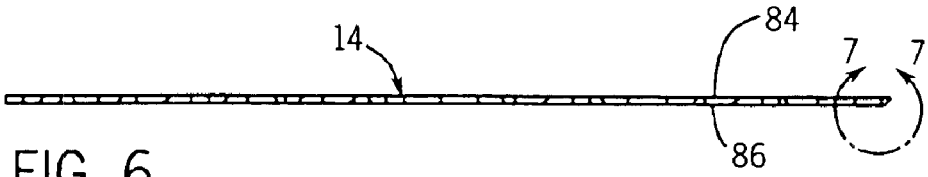
FIG. 6
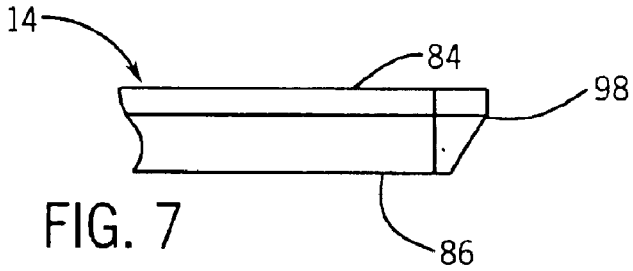
FIG. 7
FIG. 8A
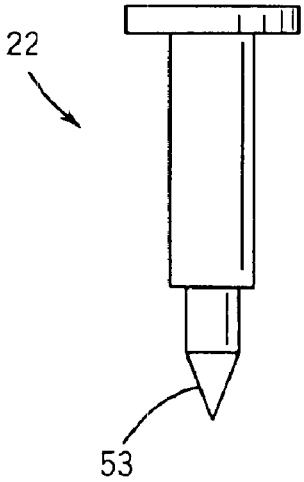
FIG. 8B
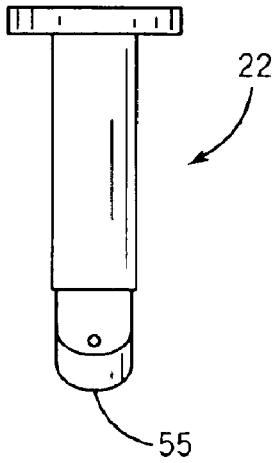

SHAPE CUTTING SYSTEM

CROSS REFERENCE TO PRIOR APPLICATIONS

This application is a continuation of U.S. patent application Ser. No. 09/769,683, filed Jan. 25, 2001, now U.S. Pat. No. 6,722,051, issued Apr. 20, 2004.

FIELD OF THE INVENTION

The present invention relates generally to a shape rendering system. More particularly, the present invention relates to the field of marking devices, including cutting devices, and templates.

BACKGROUND OF THE INVENTION

Devices for rendering marks upon materials such as paper, cardstock and photographs are generally well known. Such devices, including cutting devices, are typically configured for performing free-form marking or cutting. Many marking devices are also used in conjunction with a template for marking or cutting specific or predetermined shapes from a material. Cutting devices having an adjustable blade are also known and are typically used for cutting materials of varying thicknesses. Other cutting devices can include a swiveling blade which swivel or rotate about a longitudinal axis of the cutting device. Cutting devices typically are elongate members having housings which form a handle for grasping by a user during cutting. The housing usually connects at its lower end to the blade. The angular position of the cutting blade of the cutting device with respect to the material to be cut is typically determined by the user's hand.

Templates are also well known. Templates typically are flat sheets having first and second sides, and one or more openings formed in a variety of different shapes. The cross-sectional shape, of the periphery of the template and the edges of the template at the openings, typically defines straight-cut edges extending perpendicularly from the first side to the second side. Templates are commonly made of semi-transparent, generally flexible material. Templates used to produce geometric or other shapes of varying sizes can also be configured as nested templates. Nested templates include a series of elongate, unconnected slots which form outlines of specific shapes. When using nested templates, the user is required to cut the portions of the material to be cut which extend between the ends of the slots in order to completely outline or cut out the desired shape.

Existing devices for rendering marks and existing templates have a number of drawbacks. Existing rendering or cutting devices are typically not securely orientated in regard to angle with respect to the material. As a result, the angular orientation of the device with respect to the material to be cut (e.g., the blade of a cutting device) is often inadvertently changed causing an error in the desired marking or cutting. Existing devices which do fix the angular orientation of the cutting device with respect to the material are typically configured for free-form cutting only and do not properly function in conjunction with templates. Other devices which fix the angular orientation of the cutting device with the material to be cut are large, expensive devices which are often difficult to operate and to transport.

Further, existing cutting devices are typically formed of non-transparent material which partially obstructs the user's view of the material to be cut. Also, many cutting devices utilize a bottom-load blade connection of the blade to the housing of the device. The bottom-load connection of the blade to the housing makes the blade susceptible to becoming dislodged from the housing during operation. Existing cutting devices also typically do not include blade depth indication which increases the likelihood of blade depth mis-adjustment. Existing cutting devices also typically do not accommodate spare blades or blade assemblies. Those cutting devices, which have a rotatable or swivelable blade, are not typically configured for use with a template. When not in operation, existing cutting devices often have exposed cutting blades which are susceptible to contact by the user.

Existing templates are not configured for effective operation with cutting devices, and in particular, with cutting devices wherein the housing and the blade assembly are maintained in a generally fixed orientation with respect to the template. The periphery and the edges at the openings of existing templates often cause existing rotatable or swiveling blade assemblies to bind which can result in mis-cuts. Also, existing nested templates produce incomplete shapes and require the user to undertake a secondary cutting or marking operation, typically without the aid of the template, to complete the cutting or marking of the desired shape.

Thus, there is a need for a device for rendering marks or cuts onto a material which maintains the marking assembly in substantially constant angular orientation with respect to the material to be cut and which is configured for use in either a free-form rendering mode or a template rendering mode. There is also a continuing need for cutting device which is configured for single-hand operation and which can be adjusted without the use of tools. What is needed is a cutting device having a blade assembly which is not susceptible to separation from the lower portion of the housing and a cutting device which indicates the depth of the cutting blade. A cutting device configured to prevent contact with the blade when the device is not in use is also needed. Further, there is a continuing need for a cutting device having many of these attributes which also accommodates spare blade assemblies and which enables the replacement of blades without the use of tools. Additionally, there is a need for a template which operates effectively with a rotatable or swiveling cutting blade of a cutting device. In addition, a template is needed which enables the continuous and uninterrupted cutting of shapes of varying sizes.

SUMMARY OF THE INVENTION

The present invention provides a shape cutting system for cutting a material having a surface. The shape cutting system includes a cutting unit and at least one template. The cutting unit includes a frame, a blade adjustment assembly coupled to the frame, and a blade assembly coupled to the frame. The frame has a lower support surface. The blade assembly is positioned at least partially within the frame such that a longitudinal axis of the blade assembly is substantially perpendicular to the lower support surface of the frame. The blade assembly includes a blade retainer and a blade connected to the retainer which has a rigid collar. The blade assembly is rotatable about the longitudinal axis. The at least one template has first and second substantially flat surfaces, a periphery and at least one edge defining at least one opening. The frame of the cutting unit has a lower surface for contacting at least one of the first surface of the template and the material to be cut. The second surface of the template is configured for placement upon the material to be cut. The rigid collar of the retainer is configured to operatively engage either the periphery of the edge of the opening of the template. The engagement of the collar to the template enables the blade to cut a shape in the cutting material which assimilates the shape of at least a portion of the at least one of the periphery and the edge.

According to a principal aspect of a preferred form of the invention, a device for rendering shapes upon a material wherein the device may be used in conjunction with at least one template. The device includes a frame, a marking device adjustment assembly and a marking device assembly. The frame includes a base and a housing. The base includes a substantially flat lower surface for contacting one of the material to be cut and the template. The housing is coupled to the base and also has first and second interconnected openings. The housing is supported by the base in at least one position above the lower surface of the base. A marking device adjustment assembly is coupled to the housing at the first opening. A marking device assembly is operatively coupled to the marking device adjustment assembly. The marking device assembly is at least partially enclosed by the housing at the second opening of the housing. The second opening of the housing is sized to enable a lower portion of the marking device assembly to partially and adjustably extend through the second opening, and to prevent the marking device assembly from fully extending through the second opening.

According to another aspect of the invention a device is included for rendering shapes upon a material wherein the device may be used in conjunction with at least one template. The device includes a frame, a marking device adjustment assembly, and a marking device assembly. The frame has a substantially flat lower surface for contacting one of the material to be cut and the template. The flat lower surface is sized to support the frame in an upright position. The marking device adjustment assembly is coupled to the frame. The marking device assembly is at least partially enclosed by the frame and is operatively coupled to the marking device adjustment assembly. The frame has a storage compartment for storing at least additional marking device assembly.

According to a another aspect of the invention a template is included for facilitating the rendering of shapes onto a material by a rendering device. The template includes a substantially flat sheet having first and second sides, a periphery and at least one opening extending from the first side to the second side. The first side of the sheet is configured for placement upon the material to be cut. The second side of the sheet is configured to contact the rendering device. The sheet is made of a semi-transparent tinted template material. The first side laterally extends at the periphery and at the one opening farther than the second side to define a chamfer at the periphery and at the one opening of the template.

This invention will become more fully understood from the following detailed description, taken in conjunction with the accompanying drawings described herein below, and wherein like reference numerals refer to like parts.

BRIEF-DESCRIPTION OF THE DRAWINGS

FIG. 6 is a side view of the template of FIG. 5;

FIG. 7 is a detailed view of the template along the section B of the template of FIG. 6;

FIG. 8A is a side view of a blade assembly in accordance with an alternative preferred embodiment of the present invention; and FIG. 8B is a side view of a blade assembly in accordance with another alternative preferred embodiment of the present invention.

DETAILED DESCRIPTION OF THE PREFERRED EMBODIMENTS

Figure 1:
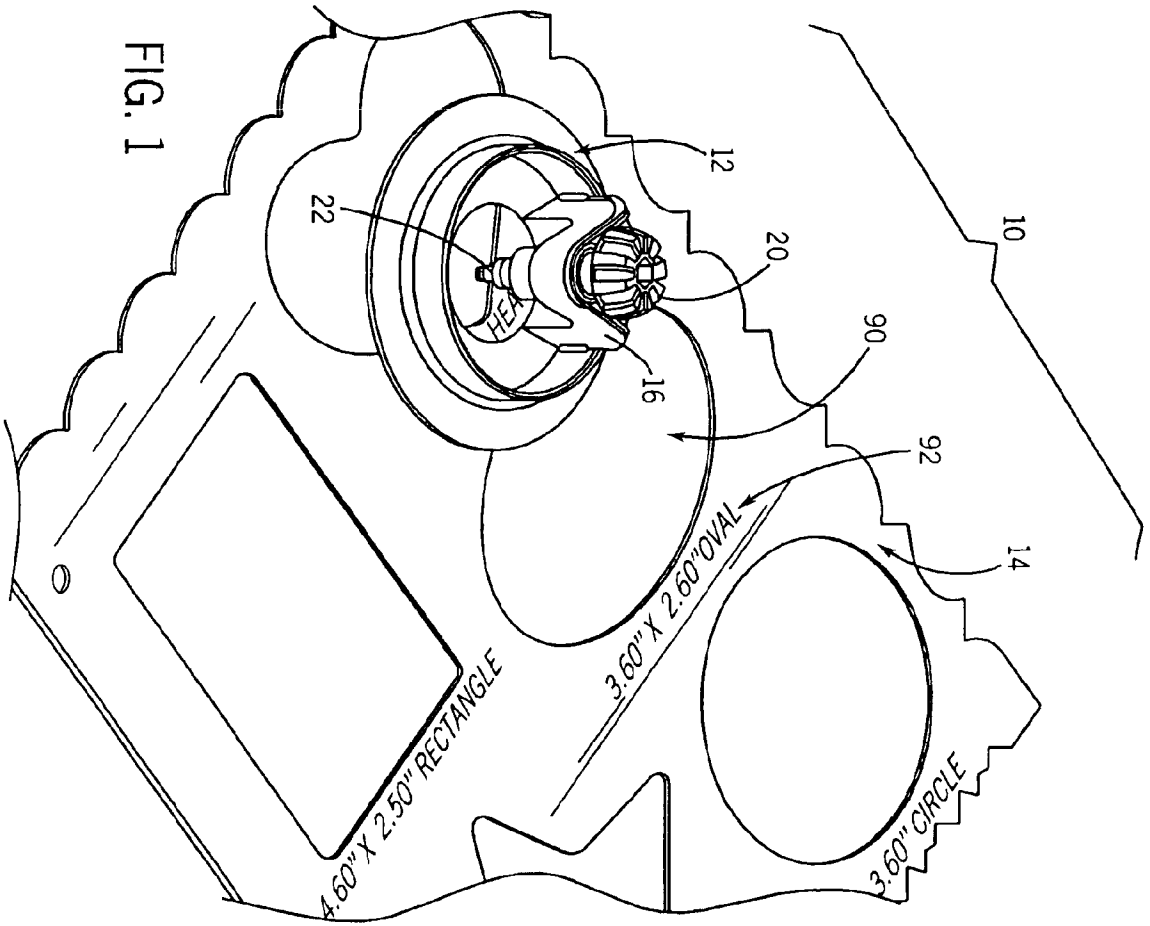
FIG. 1 is a perspective view of the cutting system, including a cutting unit and a template, in accordance with a preferred embodiment of the present invention.

Referring to FIG. 1, a shape cutting system is indicated generally at 10. The shape cutting system 10 includes a cutting unit 12, at least one template 14 and a cutting mat 15 (see FIG. 5). The cutting unit 12 is a lightweight, handheld positionable assembly configured for operation with one of the templates 14 and for application directly onto a material to be cut without templates. The cutting unit 12 is also configured to cut material such as paper, card stock, photographs, and other related goods into desired shapes or patterns. The cutting unit 12 functions in at least two operating modes. In the first operating mode, a free-form or free-hand mode, the cutting unit 12 is placed directly upon the material to be cut and is translated preferably by a single hand of the user, in the desired direction across the material to perform free-form cutting. In the second mode of operation, the template cutting mode, the cutting unit 12 works in conjunction with at least one of the templates 14 to cut a prescribed or predetermined pattern, segment or shape, as outlined by the template 14 and as desired by the user. In an alternative preferred embodiment, the shape cutting system 10 can be used to render marks, not including cuts, onto a material as opposed to cutting the material. In such a preferred embodiment, the cutting unit 12 would be substituted with another marking device, such as a writing instrument. The cutting unit 12 is sized for ambidextrous single hand operation and to be easily transported or stored.

Figure 2:
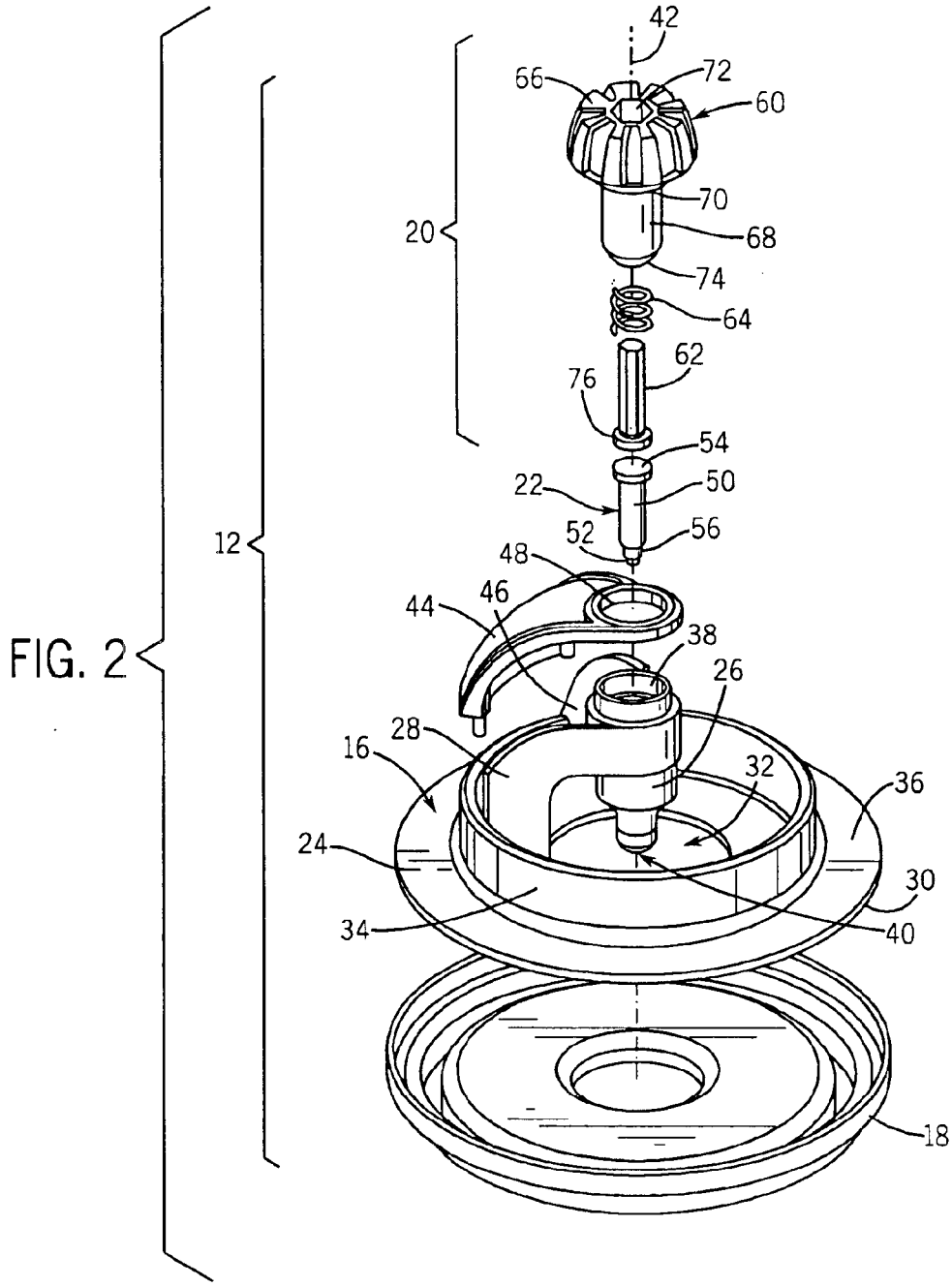
FIG. 2 is an exploded perspective view of a cutting unit of the shape cutting system of FIG. 1.

FIG. 2 illustrates the cutting unit 12 in greater detail. The cutting unit 12 includes a frame 16, a protective cover 18, a blade adjustment assembly 20 and a swivel blade assembly 22. The frame 16 is preferably a handheld, one-piece support structure. The frame 16 is preferably configured for supporting and partially enclosing the blade adjustment assembly 20 and the blade assembly 22. The frame 16 is also configured for removable contact with the template 14 or the material to be cut. The frame 16 is made of a durable, lightweight material, preferably, a clear, semi-transparent polycarbonate material. Alternatively, the frame 16 can be made of different materials such as, for example, other thermoplastic materials, metal, wood or glass.

The frame 16 includes abase 24, a housing 26 and an arm 28. The base 24 is a support structure having a substantially flat lower surface 30 and an aperture 32 defined within its center. The base 24 is coupled to the housing 26 by the arm 28. The base 24 is configured to be easily translated over a surface of the material to be cut or an outer surface of one of the templates 14. The base 24 is also configured to securely support the housing 26 in a fixed position. In a preferred embodiment, the base 24 securely integrally supports the housing 26 in a position substantially perpendicular to the lower surface 30 of the base 24. The aperture 32 is configured to enable the blade assembly 22 to partially extend therethrough during operation. The base 24 further includes a wall 34 upwardly extending from an upper surface 36 of the base 24. The wall 34 and the upper surface 36 of the base 24 combine to provide an annular handle which is configured to be easily grasped by the user enabling the user to easily move the cutting unit 12 in any direction across a surface of the material to be cut or the template 14. The base 24 is preferably an annular member. Alternatively, the base 24 can be formed in other shapes such as, for example, a rectangular shape, an oval shape, a U-shape, or other conventional shapes.

The housing 26 is a generally cylindrical body having first and second openings 38 and 40. The housing 26 is preferably integrally connected to the arm 28 and coupled to the base 24. The first and second openings 38 and 40 of the housing 26 are defined to interconnect and axially extend through the housing 26 along a longitudinal axis 42. The housing 26 is removably connected to, and partially encloses, the blade assembly 22 at the second opening 40 and the blade adjustment assembly 20 at the first opening 38. The housing 26 is configured to retain at least a portion of the blade assembly 22 and a portion of the blade adjusting assembly 20. The housing also allows top-loading of the blade assembly 22 into the housing 26 through the first opening 38. The housing 26 is also configured to prevent the blade assembly 22 from fully extending through the second opening 40 of the housing 26. This feature prevents the inadvertent separation or dislocation of the blade assembly 22 from the lower end of the housing 26 during operation. The housing 26 is also configured to enable the blade assembly 22 to move axially in a plurality of different positions based upon the adjustment of the blade adjusting assembly 20, and to enable the blade assembly 22 to rotate, pivot and swivel about the axis 42 during operation.

The arm 28 is a curved support structure preferably having a partial, generally spherical shape. The arm 28 is preferably integrally connected to the base 24 and to the housing 26 for supporting the housing 26 above the aperture 32 of the base 24. The arm 28 is configured to fixedly secure the housing 26 along the axis 42 in a position substantially vertical to the lower surface 30 of the base 24. This configuration ensures that the blade assembly 22 is continuously maintained by the housing 26, and the frame 16 is maintained in a substantially vertical position with respect to the base 24 when the base 24 is placed on a substantially horizontal surface. When in use, the arm 28 fixedly secures the angular orientation of the housing 26 with respect to the material to be cut. The configuration of the frame 16 eliminates the need for the user of the cutting unit 12 to adjust the angular orientation of the housing 26 and the swivel blade assembly 22 during operation. In alternative embodiments, the arm 28 can be configured to support the housing 26 and the blade assembly 22 in a plurality of different angular orientations with respect to the base 24.

In a preferred embodiment, the arm 28 is a generally hollow structure and further includes an arm cover 44. The arm 28, including the cover 44, form a spare blade assembly storage compartment 46 for receiving at least one spare blade assembly. The arm cover 44 is a curved, and partially generally spherical, member having an opening 48 at its upper end. The arm cover 44 is pivotally connected to the upper end of the housing 26 at the opening 48. The opening 48 is configured to receive the upper end of the housing 26 and is coaxially aligned with the first opening 38 of the housing 26. The cover 44 is configured to pivot about the axis 42 to enable a user to releasably access the storage compartment 46. The arm cover 44 is made of a lightweight durable substantially transparent material, preferably, a clear polycarbonate material. Alternatively, the arm cover 44 can be made of other materials such as, for example, other thermoplastic materials or glass.

The storage compartment 46 of the arm 28 is sized to hold at least one spare blade assembly. The semi-transparent material of the arm 28 readily enables the user to visually ascertain whether a replacement blade assembly is stored within the storage compartment 46 without having to reposition the arm cover 44 from the arm 28 or disassemble the cutting unit. Alternatively, the arm 28 can be formed in other shapes or configurations, and it can be formed out of two or more members extending from the base 24. Additionally, the storage compartment can be located at other locations on the frame 16, such as, for example, formed as part of the base 24.

The protective cover 18 is a generally circular disk. The cover 18 is removably connected to the base 24 and covers the lower surface 30 of the base 24 including the aperture 32. The cover 18 prevents a user from inadvertently contacting the blade assembly 22 when the cutting unit 12 is not in use or when the cutting unit 12 is removed from contact with the cutting material. The cap 18 is made of a lightweight, flexible and durable material. Preferably, the cap 18 is made of a plastic, but alternatively, other conventional materials can also be used. The cover 18 provides a secure, lightweight, reusable and inexpensive means for safely protecting the user from contact with the blade assembly 22 when the cutting unit 12 is not in use. Alternatively, the cover 18 can be formed in other configurations which prevent contact with the blade assembly 22 installed in the frame 16, such as a cap for the lower end of the housing 26 and the blade assembly 22. In another alternative embodiment, the blade assembly 22 can be configured to be completely retractable within the housing 26.

The blade assembly 22 is removably inserted and substantially enclosed by the housing 26. The blade assembly 22 is inserted through the first opening 38 of the housing 26 and extends along the axis 42 within the housing 26 such that the lower portion of the blade assembly 22 outwardly extends from the second opening 40 of the housing 26.

The blade assembly 22 includes a blade retainer 50 and a cutting blade 52. The retainer 50 is a cylindrical body having an enlarged upper end 54 and a lower end formed having a diameter which is smaller than the diameter of the main portion of the retainer 50. The lower end of the retainer 50 forms a collar 56. The retainer 50 is sized to fit within the first opening 38 of the housing 26, to extend through the interior of the housing 26, and to partially and adjustably extend through the second hole 40 of the housing 26. The retainer 50 is also sized to angularly rotate or swivel about the axis 42 during operation in either a clockwise or counterclockwise direction. The swiveling or rotating feature of the blade assembly 22 with respect to the frame 16 enables the blade to follow a profile or shape defined in one of the templates 14. The swiveling blade can follow the free-form movement of the user's hand across a surface without requiring the separate adjustment of the blade by the user during operation. The retainer 52 is configured to adjustably and axially extend within the housing 26 in response to the adjustment of the blade adjustment assembly 20. The retainer 50 is made of a lightweight durable inexpensive material, preferably a plastic. Alternatively, other materials can also be used such as, for example, wood or metal. In an alternative embodiment, the retainer 50 can be configured to retain more than one blade or blades of varying sizes.

The upper end 54 of the retainer 50 is sized so as to prevent the retainer 50 from fully extending in an axial manner through the second opening 40 of the housing 26. The upper end 54 also includes an upper bearing surface which is configured to removably and operatively contact the blade adjusting assembly 22. This enables the retainer 50 to rotate or swivel with respect to the axis 42 and with respect to the blade adjustment assembly 20, or to move axially along the axis 42.

The collar 56 is configured to removably contact an edge of one of the templates 14 and is configured to facilitate the operation of the blade assembly 22 in conjunction with one of the templates 14. Specifically, the collar 56 is configured to slide along and rotate as necessary with respect to an edge or the periphery of the template 14, thereby enabling the blade 52 to conform to the shape defined in the template 14.

The blade 52 is preferably a conventional single-edged blade which is preferably press-fit to the lower end of the retainer 50. The blade 52 downwardly extends from the lower end of the retainer 50 and includes a cutting edge. The cutting blade 52 is most preferably made of a metallic material. In an alternative embodiment, the blade 52 can be a double edged blade 53 (see FIG. 8A), a rotary blade 55 (see FIG. 8B) or comprise multiple blades for cutting materials such as, for example, paper, cardboard and cloth. In another alternative embodiment, the blade 52 can be replaced with a writing or marking implement or a tool, such as a drill bit.

Referring to FIG. 2, the blade adjustment assembly 20 is an adjustable device removably connected to the base 24 at the first opening 38 of the housing 26. The blade adjustment assembly 20 is operatively coupled to the blade assembly 22. The blade adjustment assembly 20 is configured for the application of varying amounts of downward pressure to the blade assembly 22, which results in a corresponding variation in the amount of downward pressure applied to the blade assembly 22 for the cutting of material.

The blade adjustment assembly 20 includes a knob 60, a plunger 62 and a biasing device 64. The knob 60 is a generally cylindrical member having an operating mode indicating portion 70 formed between an enlarged upper end 66 and a lower end 68. The lower end 68 of the knob 60 is removably connected to the housing 26 at the first opening 38. The lower end of the knob 60 is also operatively coupled to the plunger 62 and the biasing device 64. In a preferred embodiment, the lower end 68 of the knob 60 includes external threads which engage internal threads formed in the housing 26 at the first opening 38. The knob 60 is configured to enable a user to grasp and rotate the upper end 66 of knob 60 in order to adjust the spring tension applied to the blade assembly 22, or to remove the knob 60 from the housing 26. The knob 60 is also configured to retain the plunger 62 and the biasing device 64 such that the blade adjustment device 20 maintains an adjustable downward force upon the blade assembly 22. The knob 60 is made of a lightweight durable material, preferably a plastic. Alternatively, the knob 60 can be made of other materials such as wood or glass. The upper end 66 of the knob 60 preferably includes a plurality of outwardly extending projections to facilitate grasping and rotation of the knob 60. The upper end 66 also preferably further includes an opening 72 for receiving a tool, such as an "Allen" key. The lower end 68 of the knob 60 includes a plunger receiving hole 74 for receiving a portion of the plunger 62. The lower end 68 of the knob 60 is also configured to attach or connect to one end of the biasing device 64.

The plunger 62 is a cylindrical body having an upper portion and an enlarged lower contact region 76. The plunger 62 is coupled to the knob 60 at the hole 74 and is operatively connected to the blade assembly 22 at the retainer 50. The plunger 62 also is connected to and preferably partially surrounded by the biasing member 64. The plunger 62 contacts the retainer 50 of the blade assembly 22 to transmit the downward force caused by the adjustment of the knob 60 by the user for adjusting the axial position of the blade assembly 22 with respect to the housing 26. The plunger 62 is made a durable lightweight material, preferably, a plastic. Alternatively, the plunger 62 can be made out of other materials, such as, for example, wood or metal.

The biasing device 64 is connected at one end to the knob 60 and at a second end to the plunger 62. The biasing device 64 is preferably a helical spring. The biasing device 64 provides the adjustable downward force upon the lower end of the plunger 62 to continuously urge the blade assembly 22 downward and to resist upward movement of the blade assembly 22 during operation. The configuration of the cutting unit 12 eliminates the need for a user to axially orientate the cutting unit during operation.

Figure 3:
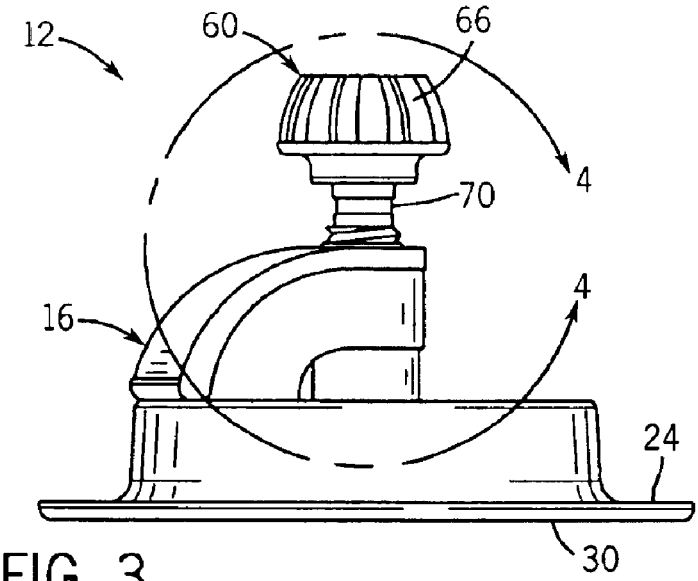
FIG. 3 is a side view of the cutting unit of FIG. 1.

FIG. 3 illustrates the cutting unit 12 in greater detail. Specifically, the substantially flat lower surface 30 of the base 24 and the central operating mode indicating portion 70 of the knob 60 are illustrated. The lower surface 30 of the base 24 is also configured to place in tension the material to be cut in order to smooth out the material for efficient cutting. The operating mode indicating portion 70 is configured to reflect the operating mode of the blade assembly 2.2 (see FIG. 2).

Figure 4:
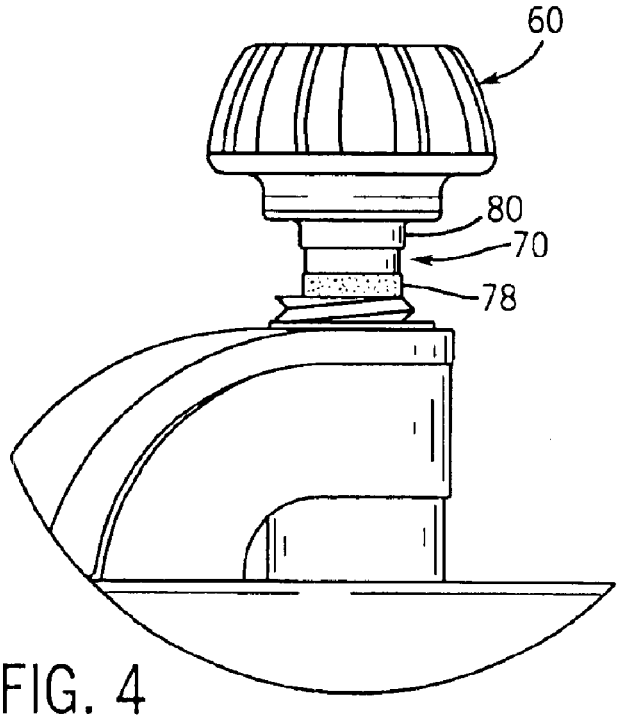
FIG. 4 is a detailed view of section A of FIG. 3.

FIG. 4 illustrates the operating mode indicating portion 70 of the knob 60 in greater detail. The operating mode indicating portion 70 includes a free-form operating range segment 78 and a template cutting operating range segment 80. When the cutting unit 12 is operating in the free-form range, the upper end 66 of the knob 60 is positioned further away from the housing 26, thereby exposing the free-form portion 78 of the operating mode indicating portion 70 of the knob 60 above the first opening 38 of the housing 26. This indicates to the user that the cutting unit 12 is in a free-form operating mode. When in the free-form mode of operation, the upward extension of the knob 60 reduces the pressure applied from the knob 60 to the biasing device 64 by enabling the biasing device 64 to upwardly extend. The decreased pressure on the biasing device results in a corresponding decrease in the pressure applied from the biasing device 64 to the plunger 62 and to the blade assembly 22. The reduced pressure exerted onto the blade assembly 22 correspondingly results in less pressure or force exerted by the blade 52 onto the material to be cut. The free-form operating range enables the blade 52 to more easily upwardly and axially deflect during operation. The reduced pressure exerted onto the blade assembly 22 results in more efficient and effective free-form movement and cutting of the blade assembly 22 during free-form operation.

When the user desires to operate the cutting unit 12 in the template cutting mode of operation, the user simply re-positions the upper end 66 of the knob 60 closer to the housing 26, until the free-form operating range segment is disposed within the housing 26 and the template cutting operating range segment 80 is visible above the first opening 38 of the housing 26. This repositioning of the upper end 66 increases the downward pressure exerted on the biasing device 64 which correspondingly results in an increase in the pressure exerted by the biasing device 64 onto the blade assembly 22. The increased pressure exerted onto the blade assembly 22 results in an increase in the pressure or force of the blade 52 against the material to be cut. When operating in the template cutting mode of operation, the blade assembly 22 deflects upward less easily than when in the free-form operating mode. The increased downward pressure applied to the blade assembly 22 during the template cutting mode of operation enables the collar 54 of the blade assembly 22 to effectively contact and operate with the edges of a template while maintaining an effective cutting force on the material to be cut. The blade assembly 22 retains the ability to swivel during operation in either the free-form or the template cutting operating modes. The pressure with which the blade 52 presses against the material to be cut is determined by the position of the upper end 66 of the knob 60 with respect to the housing 26. Rotating or screwing the knob 60 down, gradually increases the pressure on the blade and subsequently allows a thicker medium to be cut.

Figure 5:
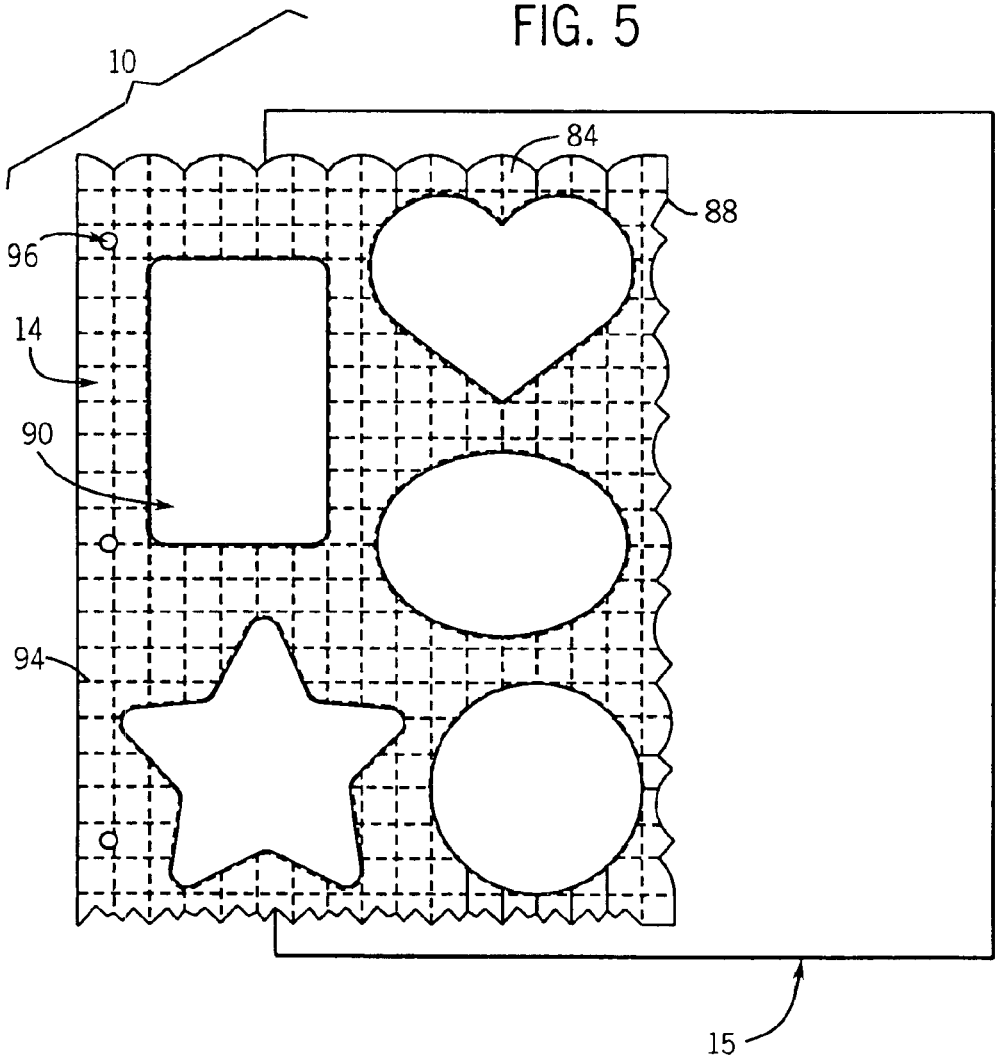
FIG. 5 is a top perspective view of a template and a mat of the shape cutting system of FIG. 1.

Referring to FIG. 5, the template 14 and the cutting mat 15 are illustrated in greater detail. The template 14 is a substantially flat sheet having first and second sides 84 and 86 (see FIG. 6), a periphery 88 and at least one opening 90 extending from the first side 84 to the second side 86. The second side 86 of the template 14 is configured for placement upon the material to be cut. The first side 84 of the template 14 is configured to contact the cutting unit 12. The template 14 is also configured to facilitate the cutting of shapes or the rendering of marks upon a material. The template 14 is made of a lightweight and durable material. Preferably, the template 14 is made of a flexible and semi-transparent tinted material. In a particularly preferred embodiment, the template 14 is made of a thermoplastic material including an edge glow substance. The edge glow substance disposal of the semi-transparent material of the template 14 is configured to redirect light passing through the template 14 to the periphery, or to the edge of the at least one opening, of the template 14. The edge glow substance is a colorant, such as the colorant supplied by Clariant International, Ltd. The edge glow substance disposed within the material of the template 14 provides the periphery 88 and the edge of the openings 90 within the template 14 with a glowing appearance. The glowing appearance of the template 14 facilitates the placement of the cutting unit 12 onto the template 14, enhances the user's ability to view the overall template positioning, and provides the template 14 with an aesthetically appealing appearance.

The edges of the periphery 88 of the template 14 can be formed into a variety of different shapes such as illustrated in FIG. 5. The openings 90 each describe a complete shape, thereby eliminating the need for secondary cutting or operation. The openings 90 can also be formed in a variety of different shapes or families of shapes such as, for example, hearts, stars, geometric shapes and alphanumeric shapes. In a preferred embodiment, as shown in FIG. 1, the template 14 can include alphanumeric indicia 92 positioned at each opening 90 indicating of the size and/or the shape of each opening 90. For example, the indicia 92 could include "3.50"×2.50" OVAL" or 3.0" HEART". Alternatively, the indicia could be a numerical value next to an opening indicating the size of the opening 90.

Referring to FIG. 5, the template 14 further includes gridlines 94 formed into the first surface of the template 14. The gridlines 94 facilitate the alignment of the template 14 onto the material to be cut. The template 14 can also include binder ring openings 96 for receiving a ring of a binder (not shown). Alternatively, the openings 96 can be used in conjunction with a clamping system or for template orientation.

The mat 15 is a sheet configured for placement underneath the material to be cut. The mat is configured to support the material to be cut without impending the operation of the cutting device and to protect the surface upon which the mat 15 and the material to be cut rests. In a preferred embodiment, the mat 15 is made of a material having short or tight nap. The mat 15 is preferably made of a firm, flexible and inexpensive materials, preferably the mat 15 is made of a thermoplastic material.

Referring to FIGS. 6 and 7, the template 14 is illustrated in further detail. The template 14 is preferably formed with a chamfer 98 at the periphery 88 and at the edges of the openings 90 within the template 14. The chamfer 98 is defined within the template 14 such that the first surface 84, which contacts the cutting unit 12, laterally and outwardly extends to a greater extent than the second surface which contacts the material to be cut. The chamfer 98 facilitates the operation of the template 14 with the cutting unit 12 by enabling the collar 56 of the blade assembly 22 to operatively engage the edge or periphery of the template 14 during operation. The chamfer 98 reduces the surface area in contact with the collar 56 of the blade assembly 22 of the cutting unit 12, thereby reducing the susceptibility of the blade assembly 22 to bind during operation. The chamfer 98 also enables the user to more easily reposition or move the cutting unit 12, along the edge of one of the openings 90 or the periphery 88 of the template 14, thereby facilitating the rendering or cutting of shapes onto the material to be cut. The chamfer 98 further prevents the blade 52 of the blade assembly 22 from contacting an edge, or the chamfer 98 of, the template 14 during use, thereby preserving the integrity of the edge, or the chamfer 98 of, the template 14.

Additionally, the corners of the template 14 are configured to enable the cutting unit 12 to continuously and efficiently travel around one or more of the corners during cutting operation. This feature greatly reduces the amount of alignment required by the user when attempting to create a corner having an edge substantially similar to the template periphery 88.

While the preferred embodiments of the present invention have been described and illustrated, numerous departures therefrom can be contemplated by persons skilled in the art, for example, the cutting unit 12 can include alternative blade adjustment assembly designs comprising a gear assembly or a remotely operated assembly. Additionally, the cutting unit can be configured to reciprocate or continuously rotate about the axis. Therefore, the present invention is not limited to the foregoing description but only by the scope and spirit of the appended claims.

What is claimed is:

1. A shape cutting system for cutting a material having a surface, the system comprising:

a frame having a lower support surface, a blade adjustment assembly coupled to the frame, a blade assembly operatively connected to the frame, the blade assembly positioned at least partially within the frame such that a longitudinal axis of the blade assembly is substantially perpendicular to the lower support surface of the frame, the blade assembly including a blade retainer and a blade operatively connected to the retainer, the retainer having a rigid collar, and the blade assembly rotatable about the longitudinal axis, and a blade adjustment assembly coupled to the frame and to the blade assembly, the blade adjustment assembly including an adjusting knob, a plunger, and a biasing member in contact with both the adjusting knob and the plunger, the adjusting knob applying pressure directly against the biasing member to adjust the pressure exerted against the blade assembly.

2. The shape cutting system of claim 1 further comprising a cutting mat, the cutting mat configured for placement under the material to be cut and the cutting unit.

3. The shape cutting system of claim 1 wherein the cutting unit includes a protective cover covering the lower surface of the frame and the lower portion of the blade assembly.

4. The shape cutting system of claim 1 wherein the frame includes a base and a housing coupled to the base, wherein the housing is configured to enclose at least a portion of the blade adjustment assembly and the blade assembly, wherein the blade assembly extends along a first axis, and wherein the lower surface of the base defines a plane which is substantially perpendicular to the first axis.

5. The shape cutting system of claim 4, wherein the blade assembly is rotatable about the first axis in at least one of a clockwise and a counterclockwise direction.

6. A shape cutting system for cutting a material having a surface, the system comprising:

a frame having a lower support surface, a blade assembly coupled to the frame, the blade assembly positioned at least partially within the frame such that a longitudinal axis of the blade assembly is substantially perpendicular to the lower support surface of the frame, the blade assembly including a blade retainer and a blade operatively connected to the retainer, and the blade assembly rotatable about the longitudinal axis, and a blade adjustment assembly coupled to the frame and including a blade operating mode indicator, the position of the operating mode indicator affecting the approximate amount of downward pressure applied to the blade during operation, the blade adjustment assembly also including an adjusting knob, a plunger, and a biasing member in contact with both the adjusting knob and the plunger, the adjusting knob applying pressure directly against the biasing member to adjust the pressure exerted against the blade assembly.

7. The shape cutting system of claim 6 wherein the blade operating mode indicator indicates which of at least a first and a second operating mode the device is operating in.

8. The shape cutting system of claim 7 wherein the first operating mode is a free-form cutting mode and wherein the second operating mode is a template cutting mode.

9. A device for rendering shapes upon a material, the device comprising:

a frame having a substantially flat lower surface sized to support the device in an upright position;

a marking device adjustment assembly coupled to the frame and including an adjusting knob, a plunger, and a biasing member in contact with both the adjusting knob and the plunger, the adjusting knob applying pressure directly against the biasing member;

a marking device assembly at least partially enclosed by the frame and operatively coupled to the marking device adjustment assembly, the marking device assembly including a marking portion having a longitudinal axis substantially perpendicular to the flat lower surface of the frame and passing through the center of the device.

10. The device of claim 9 wherein the frame further includes a base having the substantially lower surface, a housing at least partially enclosing the marking device assembly, and an arm connecting the base to the housing, and wherein the arm has a storage compartment.

11. The device of claim 9 further comprising a protective cover removably operatively connected to the frame and covering at least a portion of the marking device assembly.

12. A device for rendering shapes upon a material, the device comprising:

a frame having a substantially flat lower surface, the flat lower surface sized to support the device in an upright position;

a marking device adjustment assembly coupled to the frame and including an adjusting knob, a plunger, and a biasing member in contact with both the adjusting knob and the plunger, the adjusting knob applying pressure directly against the biasing member; and a marking device assembly at least partially enclosed by the frame and operatively coupled to the marking device adjustment assembly, the frame having a storage compartment for storing at least additional marking device assembly, wherein the marking device adjustment assembly includes a marking device operating mode indicator, the position of the operating mode indicator affecting the approximate amount of pressure applied to the marking device assembly during operation, wherein the marking device assembly is comprises a blade assembly and wherein the blade assembly includes at least one of a single edged blade, a double edged blade and a rotary blade.

13. The device of claim 12, further comprising a template for facilitating the rendering of shapes onto a material by a rendering device, the template comprising:

a substantially flat sheet having first and second sides, a periphery and at least one opening extending from the first side to the second side, the first side of the sheet configured for placement upon the material to be cut, the second side of the sheet configured to contact the rendering device, the sheet made of a semi-transparent tinted template material, the first side laterally extending at the periphery and at the at least one opening farther than the second side to define a chamfer at the periphery and at the at least one opening of the template.

14. The device of claim 13 wherein the template material includes an edge glow material configured to redirect light toward the periphery and the edge of the at least one opening of the semi-transparent material.

15. A device for rendering shapes upon a material, the device comprising:

a frame having a substantially flat lower surface, the flat lower surface sized to support the device in an upright position;

a marking device adjustment assembly coupled to the frame and including an adjusting knob, a plunger, and a biasing member in contact with both the adjusting knob and the plunger, the adjusting knob applying pressure directly against the biasing member;

a marking device assembly at least partially enclosed by the frame and operatively coupled to the marking device adjustment assembly, wherein the marking device adjustment assembly is adjustably positionable in a plurality of positions and wherein each position of the marking device adjustment assembly results a different amount of downward pressure applied to the marking device assembly.

16. The device of claim 15 wherein the marking device assembly is a blade assembly and wherein the blade assembly includes at least one of a single edged blade, a double edged blade and a rotary blade.

17. The device of claim 15, further comprising a template for facilitating the rendering of shapes onto a material by a rendering device, the template comprising:

a substantially flat sheet having first and second sides, a periphery and at least one opening extending from the first side to the second side, the first side of the sheet configured for placement upon the material to be cut, the second side of the sheet configured to contact the rendering device, the sheet made of a semi-transparent tinted template material, the first side laterally extending at the periphery and at the at least one opening farther than the second side to define a chamfer at the periphery and at the at least one opening of the template.

18. The device of claim 17 wherein the template material includes an edge glow material configured to redirect light toward the periphery and the edge of the at least one opening of the semi-transparent material.

19. The device of claim 15, further comprising a protective cover removably operatively connected to the frame and covering the lower end of the marking device assembly.

* * * * *

UNITED STATES PATENT AND TRADEMARK OFFICE

CERTIFICATE OF CORRECTION

PATENT NO. : 6,877,243 B2
APPLICATION NO. : 10/791069
DATED : April 12, 2005
INVENTOR(S) : Christopher R. Carlson, William J. Schulz and Jamieson Foght It is certified that error appears in the above-identified patent and that said Letters Patent is hereby corrected as shown below:

Col. 12, line 17, "wherein" should be deleted.
Col. 12, line 18, "is" should be deleted.

Signed and Sealed this

Eighth Day of January, 2008

JON W. DUDAS
*Director of the United States Patent and Trademark Office*